US009061691B2

(12) United States Patent
Ernst et al.

(10) Patent No.: US 9,061,691 B2
(45) Date of Patent: Jun. 23, 2015

(54) METHOD AND APPARATUS FOR OPERATION OF A RAILWAY BRANCH LINE

(75) Inventors: Horst Ernst, Braunschweig (DE); Norbert Geduhn, Uetze (DE); Peter Ziegler, Braunschweig (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/994,450

(22) PCT Filed: Dec. 9, 2011

(86) PCT No.: PCT/EP2011/072289

§ 371 (c)(1),
(2), (4) Date: Jun. 14, 2013

(87) PCT Pub. No.: WO2012/080110

PCT Pub. Date: Jun. 21, 2012

(65) Prior Publication Data

US 2013/0264430 A1 Oct. 10, 2013

(30) Foreign Application Priority Data

Dec. 14, 2010 (DE) ..... 10 2010 063 005

(51) Int. Cl.
*B61L 1/02* (2006.01)
*B61L 1/06* (2006.01)
*B61L 1/08* (2006.01)

(52) U.S. Cl.
CPC ... *B61L 1/02* (2013.01); *B61L 1/06* (2013.01); *B61L 1/08* (2013.01)

(58) Field of Classification Search
CPC ..... B61L 1/02; B61L 1/06; B61L 1/08; B61L 1/168; B61L 1/164; B61L 3/02; B61L 29/284; B61L 29/222
USPC ..... 246/122 R, 114 R, 219, 293, 126, 473 R
See application file for complete search history.

(56) References Cited

U.S. PATENT DOCUMENTS

| | | | | |
|---|---|---|---|---|
| 8,540,192 | B2 * | 9/2013 | Basso et al. | 246/293 |
| 8,752,797 | B2 * | 6/2014 | Carlson et al. | 246/122 R |
| 2011/0155863 | A1 * | 6/2011 | Basso et al. | 246/114 R |
| 2012/0138752 | A1 * | 6/2012 | Carlson et al. | 246/126 |
| 2013/0264430 | A1 * | 10/2013 | Ernst et al. | 246/122 R |

FOREIGN PATENT DOCUMENTS

| | | | |
|---|---|---|---|
| AT | 503852 | A4 | 1/2008 |
| AU | 2010223446 | B2 | 2/2010 |
| DE | 19653729 | A1 | 6/1998 |
| DE | 10 2008 033 712 | A1 | 1/2010 |
| DE | 102009012986 | A1 | 9/2010 |
| EP | 2000385 | A1 | 12/2008 |

* cited by examiner

*Primary Examiner* — Jason C Smith
(74) *Attorney, Agent, or Firm* — Laurence A. Greenberg; Werner H. Stemer; Ralph E. Locher

(57) ABSTRACT

A method and an apparatus for operation of a railway branch line, which has line devices, in particular points, signals, axle counters, beacons and/or approach signaling devices, for specific functions. At least one first line device can be operated in an active mode and in a power-saving mode. In order to simplify the switching from the power-saving mode to the active mode, the active mode of the first line device is activated by a second line device when a rail vehicle moves over the second line device, possibly after a predetermined delay time has elapsed.

2 Claims, 1 Drawing Sheet

METHOD AND APPARATUS FOR OPERATION OF A RAILWAY BRANCH LINE

BACKGROUND OF THE INVENTION

Field of the Invention

The invention relates to a method for operating a railway branch line having track-mounted equipment, in particular points, signals, axle counters, beacons (balises) and/or train approach annunciators, for specific functions, wherein at least one first track-mounted device can be operated in active mode and in power-saving mode, and to an apparatus suitable for carrying out the method.

DE 10 2008 033 712 A1 discloses a railway signaling and safety system in which an interlocking-generated data telegram switches the track-mounted device from power-saving to active mode. In order to ensure a timely changeover, the precise position of the rail vehicles must be known to the interlocking. However, in the case of branch lines, i.e. for low traffic density with typically no more than two movements per hour, this information is not always available.

BRIEF SUMMARY OF THE INVENTION

The object underlying the invention is to simplify the activation of track-mounted equipment which can be operated in active mode and in power-saving mode, to minimize power consumption and obviate the need for complex cabling.

In respect of the method, this object is achieved as follows: the active mode of the first track-mounted device is activated by the second track-mounted device when a rail vehicle passes over said second track-mounted device, possibly after a delay has elapsed. For this purpose, the second track-mounted device is equipped with a train passage detection device for detecting when a rail vehicle passes over it, wherein the train passage detection device is connected via a communications link to the at least one first track-mounted device whose active mode is designed to be activatable in the event of train passage detection or after a predefined delay.

The first track-mounted device to be switched from power-saving mode to active mode is controlled by the second track-mounted device preferably disposed in the vicinity of the first track-mounted device, the second track-mounted device possessing the information that a rail vehicle is approaching the first track-mounted device. The timely switchover to active mode is triggered by the second track-mounted device when a rail vehicle is proceeding from this track-mounted device in the direction of the first track-mounted device to be activated. The timely switchover is designed such that power-saving mode is terminated as late as possible. The delay is preferably configured on the basis of the sensor-detected passage of the rail vehicle and a maximum-line-speed-dependent approach to the track-mounted device to be activated. As a result, the time window in which the first track-mounted device is operated in active mode is optimally defined. Power consumption is minimized, thereby also making it possible to extend the service life of the track-mounted device operable in power-saving and in active mode. In power-saving mode, the track-mounted device is de-energized in the sense of a sleep or standby mode. Only systems required for communications and/or "alive" signaling remain permanently operational.

In addition to activation of a first track-mounted device located ahead of the rail vehicle in the direction of travel, it is also possible for a track-mounted device already passed to be activated in order to switch it to active mode in good time for a subsequent rail vehicle. The track-mounted device to be activated can even be disposed on the opposite-direction track in the case of double-track branch lines or on a passing track in the case of single-track branch lines.

As claimed, when the vehicle passes over the second track-mounted device, energy, in particular energy for activating the first track-mounted device, is transferred to the second track-mounted device. The energy can be obtained, for example, from the slipstream or vibration and inductively transferred to the track-mounted device being passed over.

The first track-mounted device is switched back to power-saving mode once it has performed its specific function. Activation can be terminated after complete execution of the specific function of the first track-mounted device either automatically by the track-mounted device or by a switching pulse from the passing rail vehicle.

The energy-saving mode of operation is particularly advantageous if the first track-mounted device to be activated and/or the second track-mounted device initiating activation is/are powered by decentralized energy-generating equipment that is independent of a power grid. This can be, for example, a PV installation comprising a solar panel and rechargeable battery. In power-saving mode the energy requirement is greatly minimized, so that the decentralized energy-generating equipment can still be cost-effectively dimensioned even in the case of unfavorable track conditions. Power supply cables to distant energy sources are not therefore required.

If there is a wireless communications link between the first and the second track-mounted device, this also obviates the need for control cables, thereby providing significant savings potential that is particularly important for branch lines.

At least one track-mounted device is preferably implemented as a switchable first track-mounted device and simultaneously also as a second track-mounted device initiating the switching of another track-mounted device. In the case of a light signal, this could be switched, e.g. by a balise being passed over, from an energy-saving unlit state to the active state for displaying the current signal aspect and, when passed by the rail vehicle, could generate a switching pulse which is used to energize a set of points shortly to be passed over by the rail vehicle so that the set of points is reversibly powered.

The invention will now be explained in greater detail with reference to the accompanying drawings in which:

DESCRIPTION OF THE INVENTION

Figure 1:
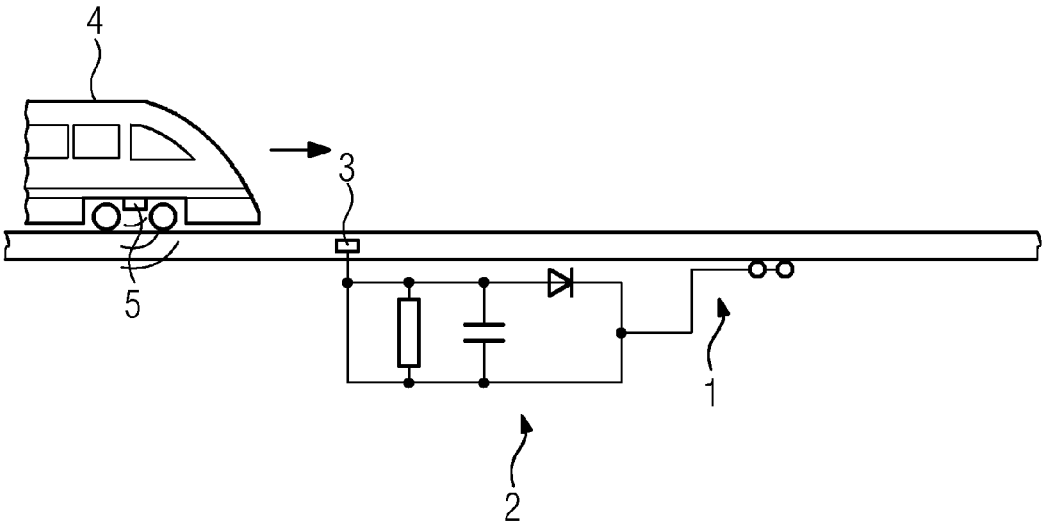
FIG. 1 shows a railway branch line with track-mounted devices.

Railway branch lines are characterized in that typically up to two movements per hour take place. The specific functions of track-mounted equipment, e.g. points, signals and grade crossings, are consequently only very intermittently required. On branch lines, it is therefore particularly effective to use track-mounted equipment that can be operated in power-saving mode and in active mode. In the following, these track-mounted devices will be termed first track-mounted devices 1. In order to switch the track-mounted device 1 from power-saving mode to active mode, a communications link 2 in the form of a signal line or a wireless communications link 2 is provided to a second track-mounted device 3, the switchover signal being generated by the passage of a rail vehicle 4 over said second track-mounted device.

As shown in FIG. 1, the second track-mounted device 3 is a balise which interacts with a trainborne balise antenna 5. The balise which is in itself designed for other functions is additionally used, as it were, for purposes other than those intended, to generate a switching pulse and transmit it via the communications link 2 to the first track-mounted device 1. As an example of a first track-mounted device 1, FIG. 1 shows an axle counting system that can be activated when required.

Figure 2:
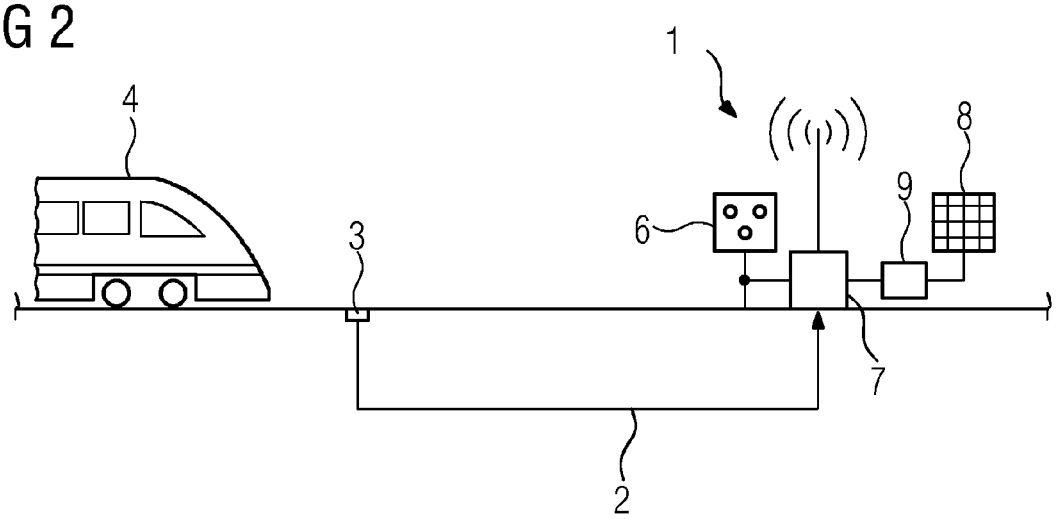
FIG. 2 shows another embodiment or another section of the railway branch line according to FIG. 1.

In the embodiment according to FIG. 2, the second track-mounted device 3, which can also be an axle counting system or the axle counting system implemented as a first track-mounted device 1 in FIG. 1, is connected to a signaling apparatus as a first track-mounted device 1. Said signaling apparatus consists of a color light signal 6 and a control device 7 which is connected to a solar panel 8 and an interposed rechargeable battery 9 as a source of power. It is only the low power consumption in power-saving mode that makes it economically feasible to use a photovoltaic system 7/8. The control device 7 activates the color light signal 6 in good time prior to the arrival of the expected rail vehicle 4, wherein a configured delay can be provided from the passage of said vehicle over the second track-mounted device 3 to the time of activation. The control device 7 is also preferably used in the normal manner for radio contact with a control center (not shown).

The invention claimed is:

1. A device for operating a railway branch line, comprising:

at least one first track-mounted device configured for selective operation in an active mode and in a power-saving mode;

a second track-mounted device including a train passage detection device for detecting when a rail vehicle passes over said second track-mounted device; and a communications link connecting said train passage detection device to said first track-mounted device;

said active mode of said first track-mounted device configured to be activatable on a train passage detection or after a predetermined delay time has elapsed; and said first track-mounted device also configured to serve as another second track-mounted device, said first track-mounted device including a train passage detection device for detecting when a rail vehicle passes over said first track-mounted device.

2. The apparatus according to claim 1, wherein said at least one first track-mounted device and said second track-mounted device are each selected from the group consisting of points, signals, axle counters, balises and train approach annunciators.

* * * * *